US009238907B2

(12) United States Patent
Murray

(10) Patent No.: US 9,238,907 B2
(45) Date of Patent: Jan. 19, 2016

(54) SPLASH GUARD FOR SINK

(71) Applicant: Samuel Murray, Charlotte, NC (US)

(72) Inventor: Samuel Murray, Charlotte, NC (US)

( * ) Notice: Subject to any disclaimer, the term of this patent is extended or adjusted under 35 U.S.C. 154(b) by 134 days.

(21) Appl. No.: 13/923,474

(22) Filed: Jun. 21, 2013

(65) Prior Publication Data

US 2014/0373269 A1 Dec. 25, 2014

(51) Int. Cl.
*A47J 47/20* (2006.01)
*E03C 1/186* (2006.01)

(52) U.S. Cl.
CPC . *E03C 1/186* (2013.01); *A47J 47/20* (2013.01)

(58) Field of Classification Search
CPC ..... A61H 35/006; E03C 1/181
USPC ..... 4/619–660
See application file for complete search history.

(56) References Cited

U.S. PATENT DOCUMENTS

| | | | | |
|---|---|---|---|---|
| 5,365,619 | A * | 11/1994 | Solomon | 4/609 |
| 5,771,504 | A * | 6/1998 | Steiner | 4/558 |
| 6,647,899 | B1 * | 11/2003 | Lysien | 108/24 |
| 7,269,861 | B1 * | 9/2007 | Miller | 4/609 |
| 2011/0258768 | A1 * | 10/2011 | Spingola et al. | 4/559 |

* cited by examiner

*Primary Examiner* — Lori Baker

(57) ABSTRACT

A splash guard includes a central base having a first linear margin and a second linear margin parallel to the first linear margin, a first wall connected to the central base along the first linear margin, the first wall having an upper portion extending upward from the central base to define a splash shield and having a lower portion extending downward from the central base to engage a host structure, and a second wall connected to the central base along the second linear margin, the second wall extending downward from the central base such that a channel for engaging a host structure is defined by the central base, the lower portion of the first wall, and the second wall.

16 Claims, 4 Drawing Sheets

SPLASH GUARD FOR SINK

TECHNICAL FIELD

The present disclosure relates to sink or basin accessories. More particularly, the present disclosure relates to a splash guard for engagement with a sink to block splashes.

BACKGROUND

Workers, housekeepers and homemakers engage in cleaning activities such as kitchen sinks and other basins and vessels where cleaning solutions such as wash water have, for example, soap content, food debris and other contaminants mixed with the wash water. In other examples, the uncooked food under preparation may contain harmful biological elements. A person engaged in activities in front of a sink or other basin typically prefers that their clothing and body remain clean and free of contaminants. Such a person may be a multitasking parent going between feeding activities, providing homework assistance, and dishwashing. This person may even experience time pressure to assist children to a bus stop or to be prepared for a social date soon after serving a meal or conducting labors of some sort. In these and other examples, donning specialized protective attire at each visit to a sink or other basin may not be convenient.

SUMMARY

This Summary is provided to introduce a selection of concepts in a simplified form that are further described below in the Detailed Descriptions. This Summary is not intended to identify key features or essential features of the claimed subject matter, nor is it to be construed as limiting the scope of the claimed subject matter.

According to at least one embodiment, a splash guard includes a central base having a first linear margin and a second linear margin parallel to the first linear margin. A first wall is connected to the central base along the first linear margin, the first wall having an upper portion extending upward from the central base to define a splash shield and having a lower portion extending downward from the central base to engage a host structure. A second wall is connected to the central base along the second linear margin, the second wall extending downward from the central base such that a channel for engaging a host structure is defined by the central base, the lower portion of the first wall, and the second wall.

In at least one example, the second wall extends vertically downward from the central base further than the lower portion of the first wall, and the channel has an inverted J-channel configuration.

BRIEF DESCRIPTION OF THE DRAWINGS

The previous summary and the following detailed descriptions may be understood when read in view of the appended drawings, which illustrate particular exemplary embodiments and features. These descriptions, however, are not limited to the exemplary embodiments and feature illustrated.

DETAILED DESCRIPTIONS

Figure 1:
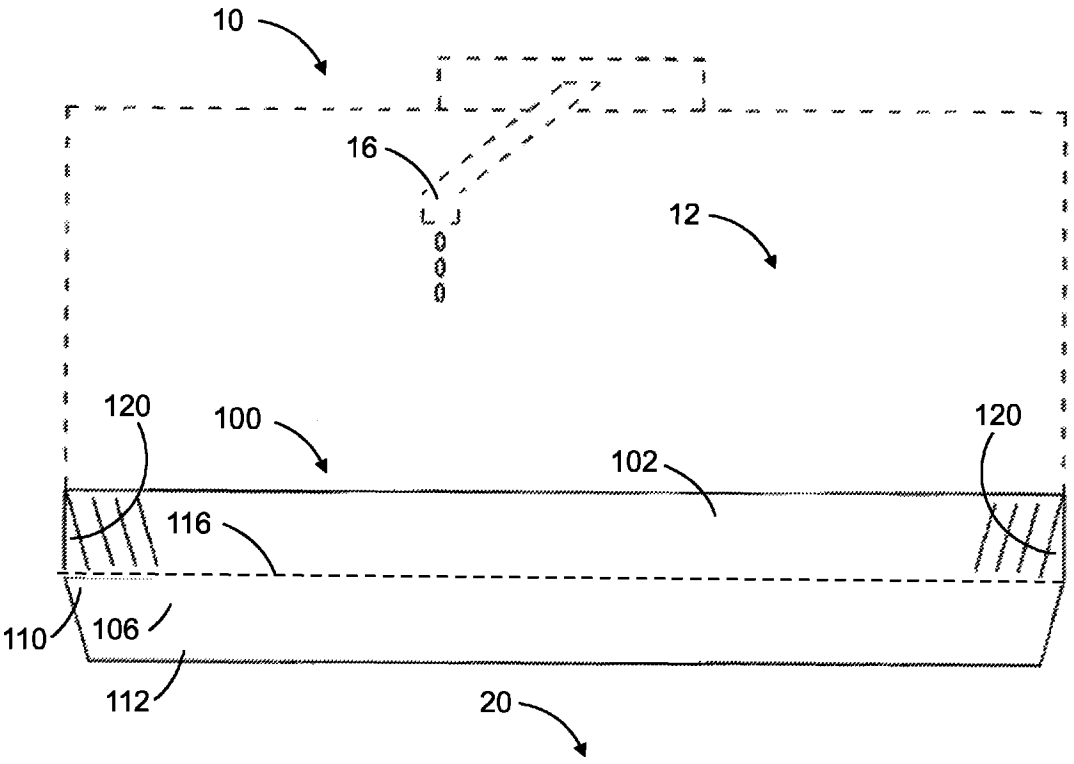
FIG. 1 is an upper perspective view of an embodiment of a splash guard, according to at least one embodiment, mounted upon a sink host structure as viewed from a user standing in front of the sink.

These descriptions are presented with sufficient details to provide an understanding of one or more particular embodiments of broader inventive subject matters. These descriptions expound upon and exemplify particular features of those particular embodiments without limiting the inventive subject matters to the described embodiments and features. Future considerations in view of these descriptions will likely facilitate additional embodiments and features which may or may not be expressly included here without departing from the scope of the inventive subject matters. Although the term "step" may be expressly used or implied relating to features of processes or methods, no implication is made of any particular order or sequence among such expressed or implied steps unless an order or sequence is explicitly stated.

A splash guard 100 according to at least one embodiment is illustrated in FIGS. 1-4. The splash guard 100 is useful at least in limiting exposure of a user to splashed or sprayed fluids or other materials such as food or waste debris at a sink 10 where a user may be engaged in cleaning dishes, preparing food, or may be otherwise engaged in activity at a sink, vat, bath, or other vessel. Other uses may come to mind in view of these descriptions. Thus, the sink 10 represents an exemplary illustrated environment and host structure for the splash guard 100 among many possible environments and host structures. In the illustrated example, the sink 10 includes a basin 12 having an upper perimeter edges. In particular, the illustrated sink 10 includes a front top edge 14 opposite a faucet 16 or other fluid supply fixture. The front top edge 14 represents a top margin of a working side of the sink 10 in the illustrated example, such that a user would likely approach the sink 10 by approaching the front top edge 14 and would likely occupy an area 20 (FIGS. 1-3) in front of the sink 10. In these descriptions, portions of the sink and splash guard typically nearer such a user are termed as front portions, whereas portions of the sink and splash guard typically further from such a user are termed as back portions. Thus, the splash guard 100 may be described as mounted to the front of the sink 10 opposite the faucet 16, whereas the faucet 16 may be described as extending over the basin 12 from the back of the sink 10.

In the illustrated embodiment, the splash guard 100 includes an elongate central planar base 102 (FIGS. 1-3) for generally horizontal placement, for example, along the front top edge 14 of the sink 10. A longitudinal channel 104 (FIGS. 2-3) is defined by the splash guard below the base 102 for receiving the front top edge 14 of the sink 10 or other host structure. In particular a first generally vertical wall 106 of the splash guard is attached to a front linear margin of the central planar base 102. The first wall 106 has an upper portion 110 that extends upward from the base 102 and a lower portion 112 that extends downward from the base 102. A second generally vertical wall 114 of the splash guard 100 is attached to a back linear margin of the central planar base 102 and extends downward from the central base generally parallel to the lower portion 112 of the first wall 106.

In the illustrated embodiment, the lower portion 112 of the first wall is parallel to the second wall 114. Furthermore, the upper portion 110 of the first wall 106 lies in a plane with the lower portion 112 such that the first wall 106 is planar. Furthermore, the upper portion 110 of the first wall 106, the lower portion 112 of the first wall 106, and the second wall 114 are perpendicular to the base 102. Accordingly, when the splash guard 100 engages a sink for use as shown in FIGS. 1-4, the base 102 is generally horizontal and the first wall 106 and second wall 114 are generally vertical. Furthermore, the base 102, the upper portion 110 of the first wall 106, the lower portion 112 of the first wall 106, and the second wall 114 are each generally rectangular.

Figure 2:
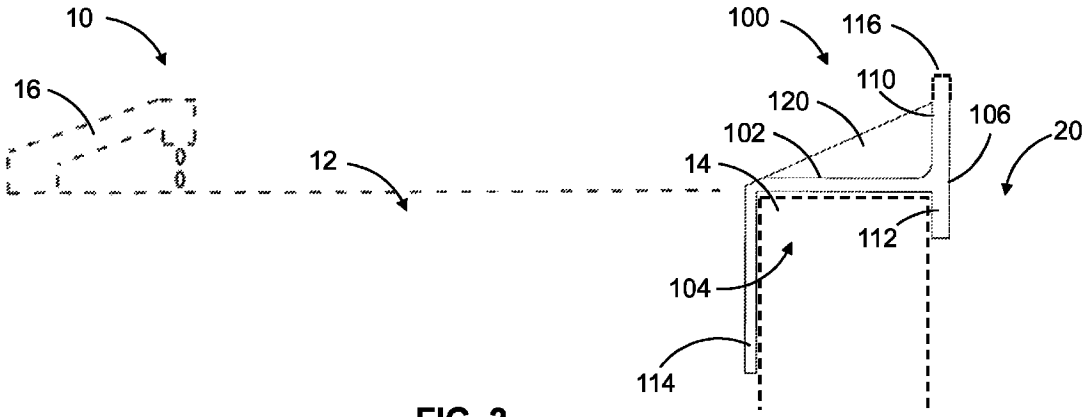
FIG. 2 is a side view of the splash guard of FIG. 1.
Figure 3:
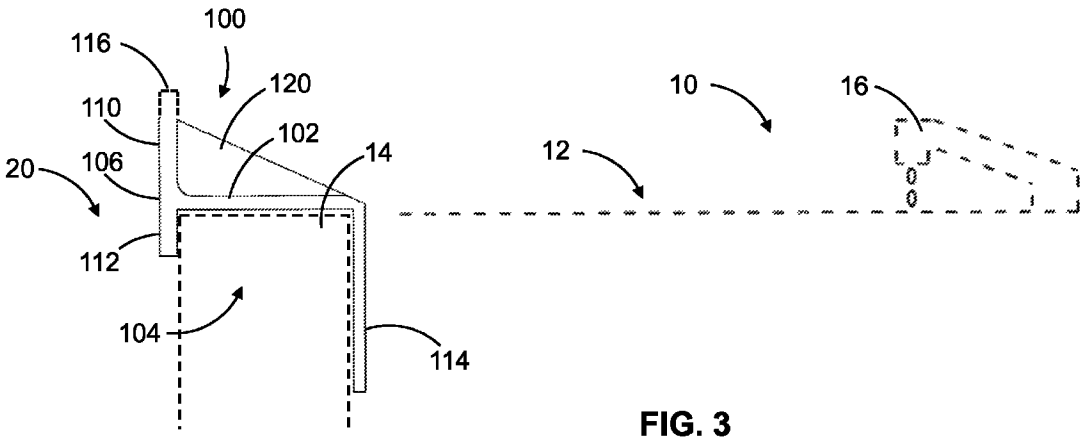
FIG. 3 is another side view of the splash guard of FIG. 1.
Figure 4:
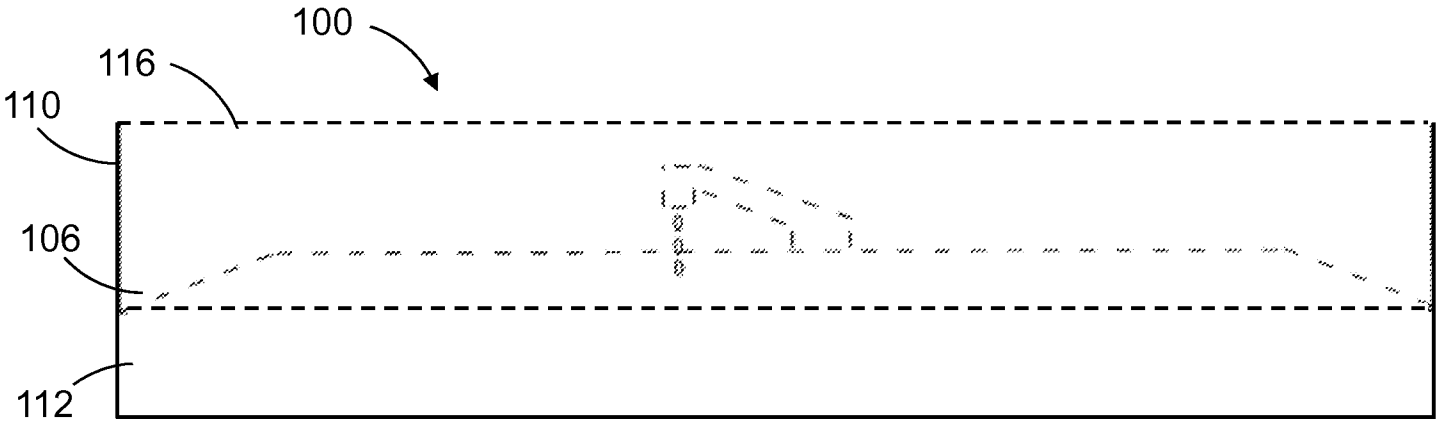
FIG. 4 is a front perspective view of the splash guard of FIG. 1, as viewed from directly in front of the sink at approximately the height of the sink such that the splash guard is in the foreground and the sink is in the background as represented by dashed lines.

The central base 102, the first wall 106 and the second wall 114 (FIGS. 2-3) extend longitudinally together such that the central base 102, the lower portion 112 of the first wall 106, and the second wall 114 together define the longitudinal channel 104. In the illustrated embodiment, the second wall 114 extends vertically downward from the central base 102 further than the lower portion 112 of the first wall 106 such that the longitudinal channel 104 has an inverted J-channel configuration. Such a configuration advantageously facilitates easy mounting of the splash guard 100, for example, to the front top edge 14 of the sink 10 by guiding the top edge 14 into the channel 104. For example, the splash guard 100 in at least one embodiment is mounted to a host structure such as a sink 10 by: first passing the lower extent of the second wall 114 into a vessel such as the basin 12; then moving the splash guard 100 downward causing an upper perimeter edge of a host structure, such as the front top edge 14 of the sink 10, to enter the channel 104; then continuing downward movement of the splash guard 100 until an upper perimeter edge of a host structure, such as the front top edge 14 of the sink 10, reaches full engagement in the channel 104. Full engagement can be reached, for example, by contacting an upper surface of the front top edge 14 with the lower surface of the base 102 of the splash guard 100. The splash guard 100, as shown in FIGS. 2 and 3, can be described as hooked onto the top edge 14 without additional straps or fixing elements.

The splash guard 100 advantageously can be separated from a host structure such as the sink 10 by disengagement of the top edge 14 from the channel 104 to permit the splash guard to be transported, cleaned, and stored. Furthermore, advantageously, upper surfaces of the illustrated embodiment of the splash guard 100 are free of fluid collection points to facilitate draining of fluids such as wash water into the basin 12.

The upper portion 110 of the first wall 106 extends upward from the base 102 to protect the body and clothing of a user from splashed or sprayed fluids or other materials such as food or waste debris. As such, the upper portion 110 of the first wall 106 defines a splash shield. Materials blocked from reaching the user by the splash shield are generally deflected or returned to the basin 12. For example, blocked fluids and debris may strike the splash shield and fall on the top surface of the base 102 and drain from there into the basin 12. The upper portion 110 of the first wall 106 extends upward from the base 102 to different heights according to different embodiments of the splash guard 100. Such variations are represented by illustration of the top margin 116 of the upper portion 110 of the first wall 106 in dashed lines in the drawings.

The splash guard 100 includes an opposing pair of sidewalls 120 (FIGS. 1-3) at or near respective longitudinal ends (FIG. 1) of the base 102. Each sidewall 120 has a horizontal margin connected to the base 102 and a vertical margin connected to the upper portion 110 of the first wall 106. The sidewalls 120 facilitate draining from the top surface of the base 102 into the basin 12 and prevent contamination of areas beyond the longitudinal ends of the splash guard 100. For example, the sidewalls 20 can prevent wash water from draining onto a countertop surrounding the basin 12. The sidewalls 120 are illustrated as triangular with a hypotenuse diagonal edge extending linearly from the upper portion 110 of the first wall 106 at a top front of the sidewall to the central base 102 at a bottom back of the sidewall, relying again upon the convention of front referring to the user side and back referring to the sink side of the splash guard. Other configurations are within the scope of these descriptions.

In the illustrated embodiment, the splash guard 100 is illustrated as constructed as a unitary structure of continuous material formed, for example, by molding. The splash guard 100 minus the sidewalls 120 can alternatively formed by extrusion, followed by assembly with the sidewall 120 by other attachment method. Other ways to manufacture the splash guard 100 will be apparent to those of ordinary skill in the art to which these descriptions pertain. In other embodiments, a splash guard according to these descriptions is assembled from separate parts. The splash guard is constructed with sufficient rigidity to generally maintain its shape for engagement with a host structure and use.

The drawings are not necessarily prepared to scale. Nonetheless, at least one embodiment of a splash guard according to these descriptions is represented to scale in the drawings. Furthermore, in at least one embodiment: the first wall 106 has a total vertical extent of approximately 2.5 inches, with the upper portion 110 having a vertical extent of approximately 2 inches, and the lower portion 112 having a vertical extent of approximately 0.5 inch; the second wall 114 has a vertical extent of approximately 4 inches; and the breadth of the base 102 as measured between the first wall 106 and the second wall 114 is approximately 3.75 inches. The breadth of the base 102, which defines the width of the channel 104, and the overall length of the splash guard 100, as measured for example from one sidewall 120 to the other sidewall 120, may each vary among various examples to accommodate various host structures such as various models of sinks Indeed, all dimensions may be varied among various examples of splash guards within the scope of these descriptions.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A splash guard for mounting on a host structure having a basin, the splash guard comprising:

a central base having an elongated lower surface and a first linear margin and a second linear margin parallel to the first linear margin;

a first wall connected to the central base along the first linear margin, the first wall having an upper portion extending upward from the central base to define a splash shield and having a lower portion extending downward from the central base; and a second wall connected to the central base along the second linear margin, the second wall extending downward from the central base such that a channel is defined by the lower surface, the lower portion of the first wall, and the second wall;

wherein the channel is configured to engage the host structure such that the lower surface rests on the host structure.

2. A splash guard according to claim 1, wherein the second wall extends vertically downward from the central base further than the lower portion of the first wall.

3. A splash guard according to claim 2, wherein the channel has an inverted J-channel configuration.

4. A splash guard according to claim 1, wherein the channel is configured such that the splash guard can be hooked onto an edge of a host structure without additional straps or fixing elements.

5. A splash guard according to claim 1, wherein the upper portion of the first wall and the lower portion of the first wall are coplanar.

6. A splash guard according to claim 5, wherein the second wall is parallel to the lower portion of the first wall.

7. A splash guard according to claim 6, wherein the second wall and the first wall are perpendicular to the central base.

8. A splash guard according to claim 7, wherein the central base, the first wall, and the second wall are each generally rectangular.

9. A splash guard according to claim 1, further comprising a pair of sidewalls, each of which is positioned at a respective longitudinal end of the central base and extends upward from the base.

10. A splash guard according to claim 9, wherein each sidewall has a horizontal linear margin connected to the central base and a vertical linear margin connected to the upper portion of the first wall.

11. A splash guard according to claim 10, wherein each sidewall is generally triangular.

12. A splash guard according to claim 11, wherein each sidewall has a diagonal edge extending linearly from the upper portion of the first wall to the central base.

13. A splash guard according to claim 1, wherein the splash guard is constructed as a unitary structure of continuous material.

14. A splash guard according to claim 1, wherein upper surfaces of the splash guard are free of fluid collection points to facilitate draining of fluids into the basin.

15. A splash guard according to claim 1, wherein the second wall and the lower portion of the first wall extend vertically downward from the central base to different vertical extents.

16. A splash guard according to claim 1, wherein:

the first wall has a total vertical extent of approximately 2.5 inches, with the upper portion having a vertical extent of approximately 2 inches, and the lower portion having a vertical extent of approximately 0.5 inch;

the second wall has a vertical extent of approximately 4 inches; and the breadth of the base as measured between the first wall and the second wall is approximately 3.75 inches.

* * * * *